US005964563A

United States Patent [19]

Bielagus et al.

[11] Patent Number: 5,964,563

[45] **Date of Patent: *Oct. 12, 1999**

[54] PIVOTING PASSIVE OVERHEAD BAG OPENER

[75] Inventors: Joseph B. Bielagus, Tualatin; James R. Montgomery, Gresham, both of Oreg.

[73] Assignee: Beloit Technologies, Inc., Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 08/754,753

[22] Filed: Nov. 21, 1996

[51] Int. Cl.[6] ..... B65B 69/00

[52] U.S. Cl. ..... 414/412

[58] Field of Search ..... 414/411, 412; 198/693; 241/167, 200

[56] References Cited

U.S. PATENT DOCUMENTS

| | | | |
|---|---|---|---|
| 3,891,105 | 6/1975 | Cerroni | 214/305 |
| 4,067,506 | 1/1978 | Cerroni | 241/200 |
| 4,344,268 | 8/1982 | Wakamatsu | 414/412 |
| 5,188,500 | 2/1993 | Eide et al. | 414/412 |
| 5,267,823 | 12/1993 | Roman | 414/412 |
| 5,282,713 | 2/1994 | Lande | 414/412 |
| 5,567,106 | 10/1996 | Gassner . | |

FOREIGN PATENT DOCUMENTS

| | | | |
|---|---|---|---|
| 2463737 | 2/1981 | France . | |
| 2 629 369 | 10/1989 | France . | |
| 2629369 | 10/1989 | France . | |
| 1 297 550 | 6/1969 | Germany . | |
| 4126372 | 2/1992 | Germany | 414/412 |
| 92 17 165 U | 2/1993 | Germany . | |
| 43 23 952 | 1/1995 | Germany . | |
| 8303265 | 9/1983 | Netherlands . | |
| 628035 | 10/1978 | U.S.S.R. | 414/412 |
| 101356 | 4/1980 | U.S.S.R. . | |
| 825379 | 4/1981 | U.S.S.R. . | |
| WO 95 31377 | 11/1995 | WIPO . | |

*Primary Examiner*—Thomas J. Brahan
*Attorney, Agent, or Firm*—Lathrop & Clark LLP

[57] ABSTRACT

A trash conveyor has thin upstanding right triangular teeth mounted parallel to their direction of motion. A pivoting deck is positioned over the conveyor and has fixed isosceles-triangular teeth which interdigitate with the teeth on the conveyor. The deck is angled upwardly towards trash infeed end of the conveyor. The deck is suspended by four pivot arms arranged in a rectangular pattern which allow the deck to pivot up and in the direction of the motion of the conveyor. Rows of teeth attached to the deck are offset from previous rows so that the spaces between the teeth on the deck and the teeth on the conveyor varies as the teeth on the conveyor move under the deck. A blade cleaner and conveyor is located beneath the trash conveyor which removes plastic bags from the teeth of the trash conveyor and rolls them into compact shapes to facilitate disposal for recycling.

28 Claims, 7 Drawing Sheets

FIG. 8
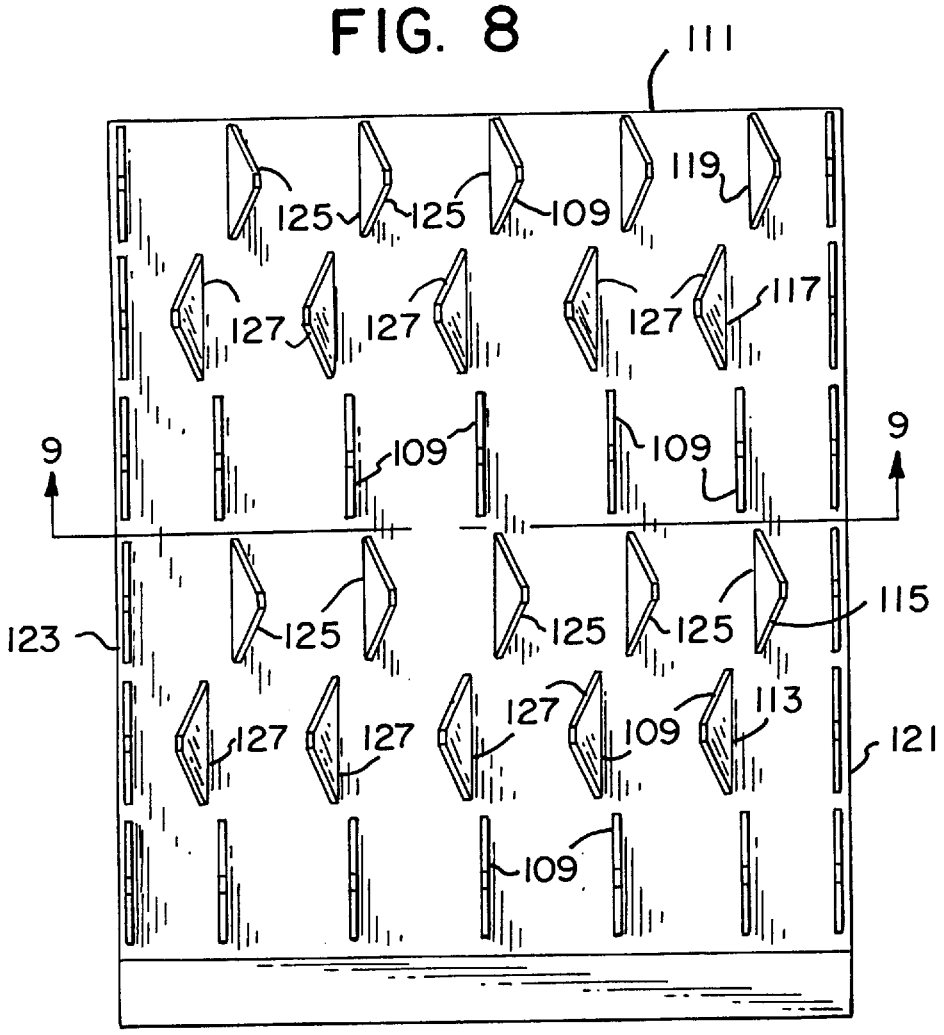
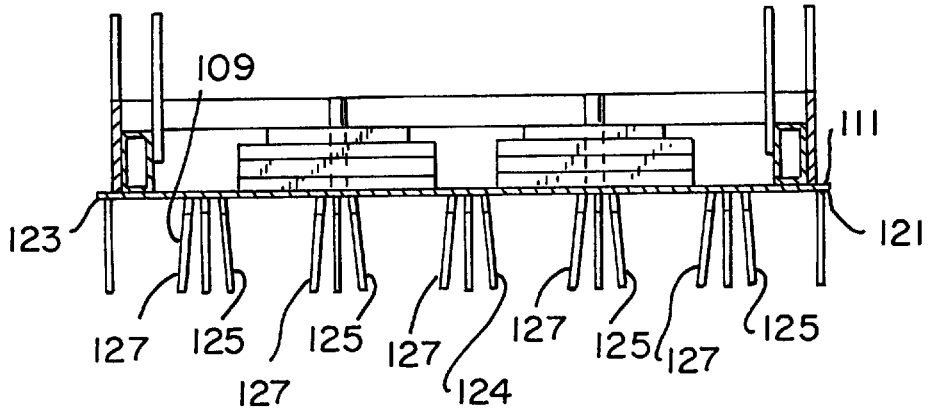
FIG. 9

PIVOTING PASSIVE OVERHEAD BAG OPENER

FIELD OF THE INVENTION

The present invention relates to bag breakers and bag openers in general, and more particularly to an apparatus for opening garbage bags.

BACKGROUND OF THE INVENTION

Municipal refuse is often placed in plastic garbage bags for disposal. Such bags are often used by consumers who find the use of garbage cans undesirable. Garbage cans are often insufficiently well sealed to prevent odors arising from the trash from becoming objectionable. Trash cans often become soiled and are thus a continuous source of noxious odors. Further, residuals attached to garbage cans can be a source of attraction of insects such as ants. For many businesses, trash bags cut down on the labor necessary in handling the trash, particularly in the need to retrieve, clean, and store trash cans after the trash contained therein has been collected. Empty trash cans have the potential to be blown about by high winds when empty. When full, trash cans can be tipped over, releasing garbage and trash to cause litter and require considerable employee time to clean up.

In some circumstances, municipal plans for recycling require that certain types of recyclable material, such as aluminum cans, plastic bottles and glass bottles, be placed in clear plastic bags for identification and collection.

Because the premature breaking of a garbage bag is highly undesirable, resulting in the complete failure of the bag's intended purpose, garbage bags are designed to resist punctures and when punctured, to resist tearing so that a sharp item contained within a trash bag, while puncturing the bag, does not result in the release of the bag's contents.

This property of trash bags to resist tearing was not a problem when municipal trash was simply landfilled. However, with increasing desirability and requirements for recycling, opening the trash bags is often necessary so that their contents may be separated for recycling.

In the past, bag openers have been designed to handle industrial commodities which are normally shipped in bags. Cement, sand, and clay for example are often sold and shipped in bags. Bag openers designed for industrial commodities typically hit or shear the bags, which are not as tear-resistant as municipal trash bags. Because the commodity-like cement or sand is not easily damaged by breaking or further comminution, the design of bag openers for industrial commodities may employ techniques that are unsuitable for opening municipal garbage bags. In opening municipal garbage bags, it is desirable to avoid breaking the contents of the bag into smaller pieces as that further complicates separating the garbage into its various constituents.

Trash bags vary in size from large bags of more than 30 gallons size to small bags such as those used to line wastebaskets. The smaller bags may go through a conventional bag breaker without being opened.

Another problem with some bag breaking apparatuses is that the tines that break the bags can become excessively entangled with empty plastic bags. The plastic bags also represent a bulky source of plastic that can be difficult and expensive to remove from the trash stream.

What is needed is a bag breaker that can reliably open bags of all sizes and has means for separating plastic bags from the trash.

SUMMARY OF THE INVENTION

The bag breaking apparatus of the present invention employs a trash conveyor of the apron feeder type that uses a belt or apron constructed of overlapping metal pans. The apron passes endlessly around two shafts that support sprocket wheels. One shaft is driven by a motor through a speed reducer Intermediate support wheels support the upper surface of the apron on which trash bags are loaded. Thin upstanding right triangular teeth are mounted by their long side to each pan parallel to the direction of motion of the trash conveyor. Thus the short vertical side faces the direction of conveyor motion and the hypotenuse of each triangular tooth faces the direction from which trash is supplied.

A pivoting deck is positioned over the trash conveyor. The deck has fixed isosceles teeth that interdigitate with the teeth on the conveyor. The deck is angled upwardly towards the front from which trash is fed. The deck is mounted by four pivot arms arranged in a rectangular pattern. The pivot arms allow the deck to pivot up and in the direction of the motion of the conveyor. Rows of teeth attached to the deck are offset from previous rows so that the space between the teeth on the deck and the teeth on the conveyor varies as the teeth on the conveyor move under the deck. An alternative arrangement of the teeth on the deck is in addition to staggering the teeth canting the staggered teeth outwardly at an angled of about 5 degrees towards the right of the deck.

A blade cleaner in combination with a conveyor is located beneath the trash conveyor which removes plastic bags from the teeth of the trash conveyor and rolls them into a compact shape to simplify disposal for recycling. The blade cleaners can be used with blades which have serrations to improve the bag removing ability of the bag breaker.

Bags of trash are supplied by an infeed chute to the infeed end of the conveyor and progress to an outfeed end.

It is a feature of the present invention to provide a garbage bag breaker that is effective in opening bags of all sizes.

It is another feature of the present invention to provide a garbage bag breaker which is less subject to jamming.

It is a further feature of the present invention to provide a garbage bag breaker that reduces bag entanglement with the bag breaking structure.

It is a still further feature of the present invention to provide a garbage bag breaker which collects and compacts plastic garbage bags.

Further objects, features and advantages of the invention will be apparent from the following detailed description when taken in conjunction with the accompanying drawings.

BRIEF DESCRIPTION OF THE DRAWINGS

FIG. 8 is a bottom view of an alternative embodiment of the deck employed with the bag breaker of FIG. 1.

FIG. 9 is a cross-sectional view of the deck of FIG. 8 taken along section line 9—9.

DESCRIPTION OF THE PREFERRED EMBODIMENTS

Figure 1:
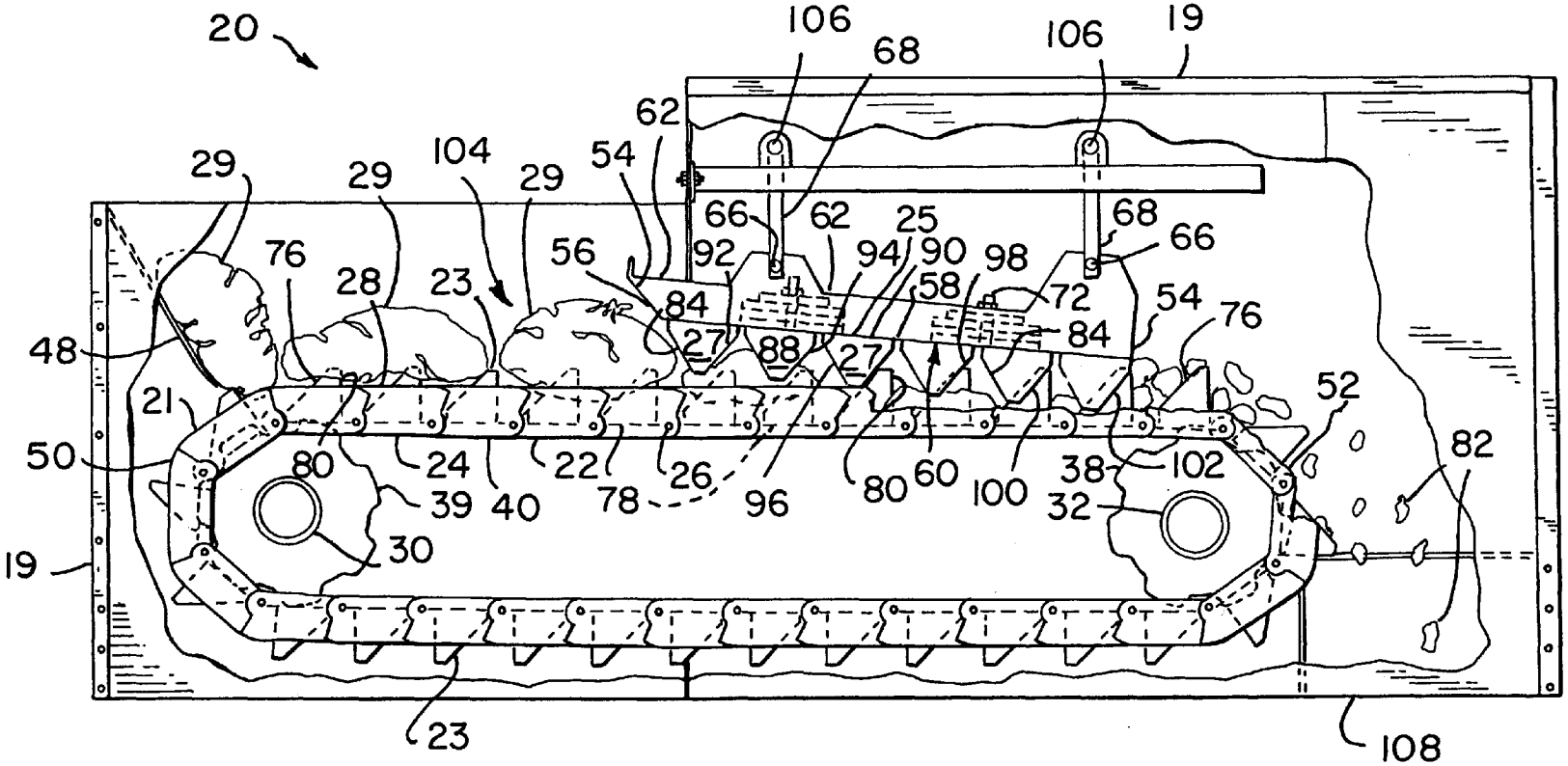
FIG. 1 is a side elevational view partly cutaway of the bag breaker of this invention.
Figure 2:
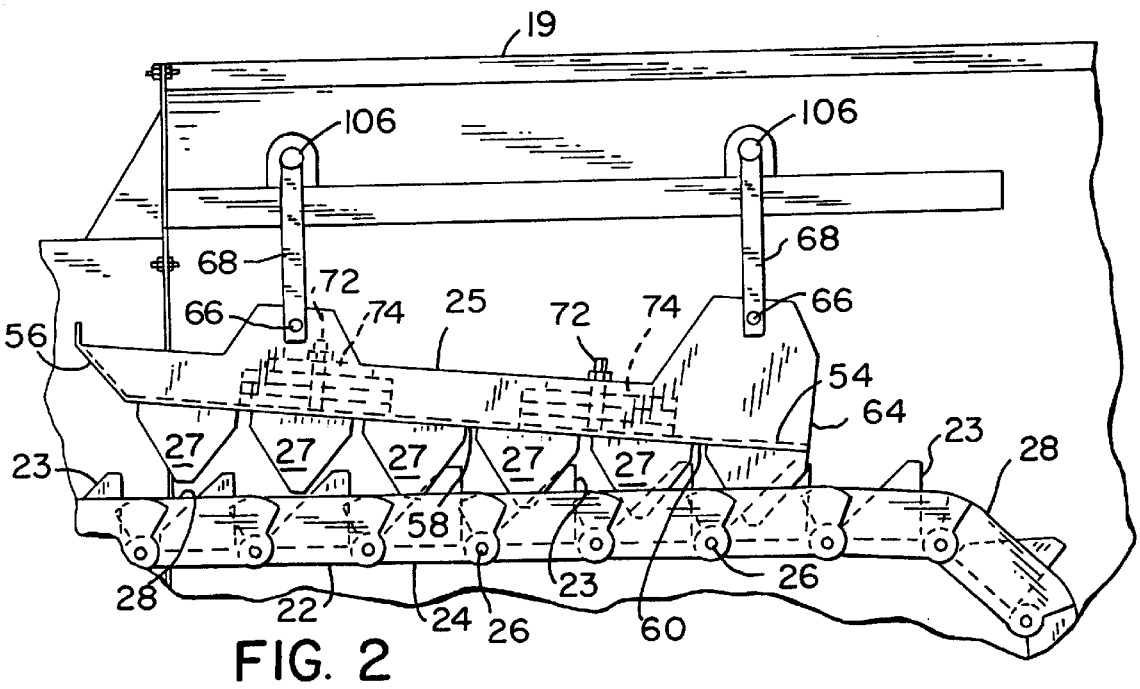
FIG. 2 is an enlarged detail view of the pivoting deck of FIG. 1 showing the deck in the down position.

Referring more particularly to FIGS. 1–11 wherein like numbers refer to similar parts, a bag breaker 20 is shown in FIG.1 which has a frame 19 to which is mounted a trash conveyor 21. The conveyor 21 has an endless apron 22 constructed of overlapping pans 24 on which are mounted triangular upstanding teeth 23. A pivoting deck 25 with depending teeth 27 is positioned over the trash conveyor 21. The teeth 23 on the conveyor 21 and the teeth 27 on the deck pass by one another or interdigitate, and this action tears open trash bags 29.

Figure 4:
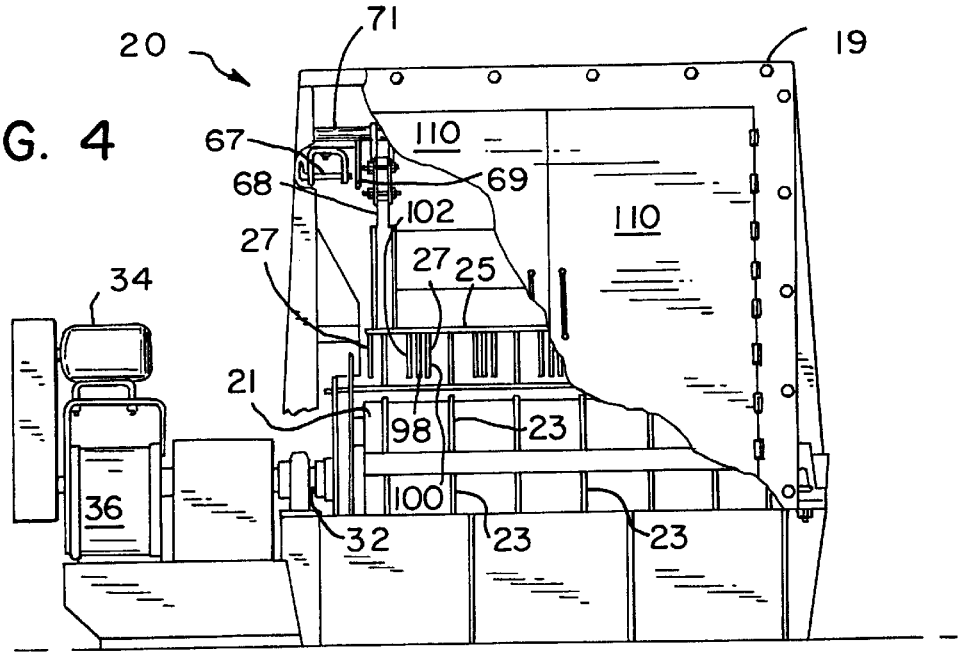
FIG. 4 is a rear elevational view, partly broken away, of the bag breaker of FIG. 1.
Figure 5:
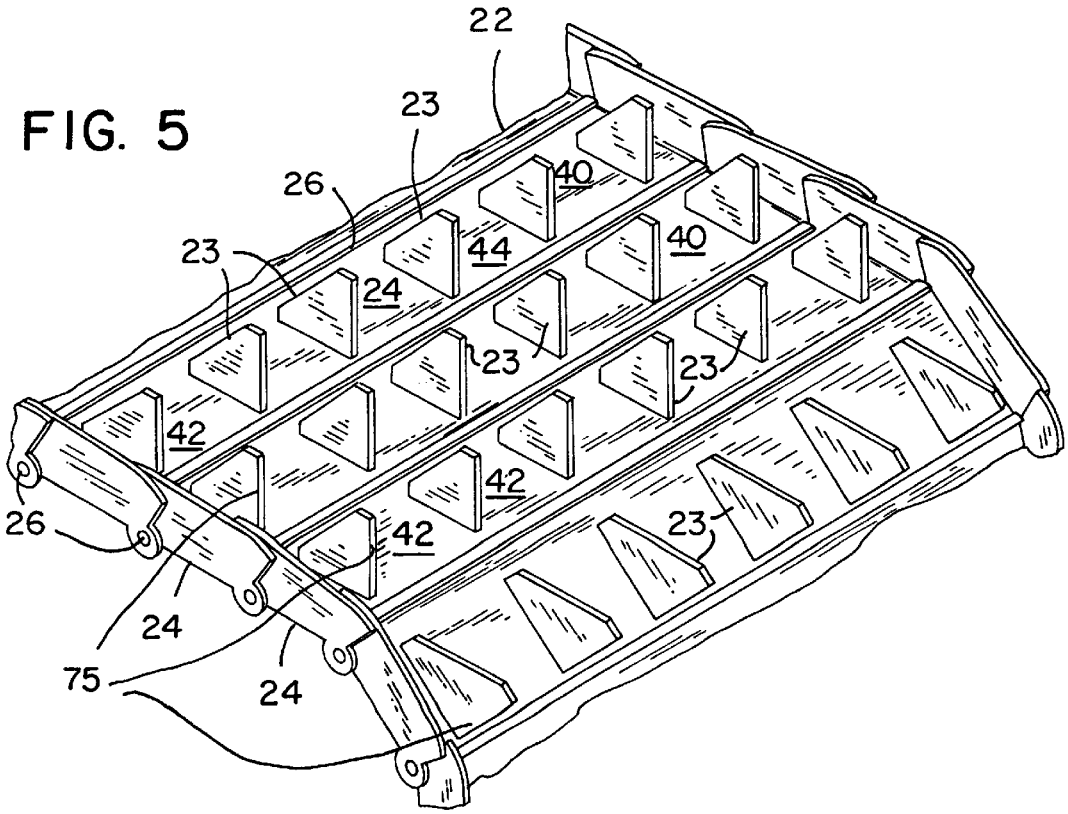
FIG. 5 is a fragmentary isometric view of the trash conveyor of FIG. 1.
Figure 6:
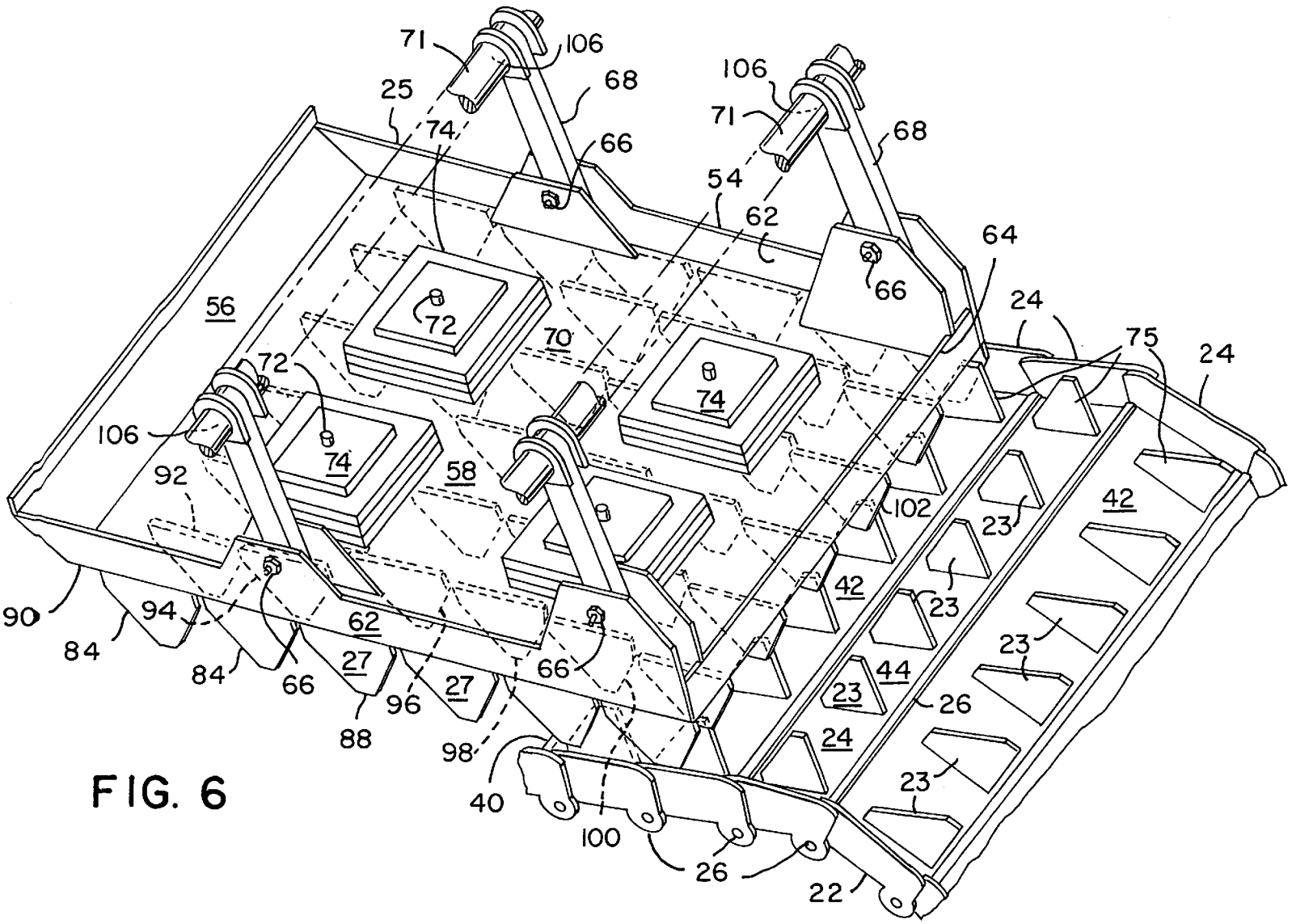
FIG. 6 is a fragmentary top isometric view of the pivoting deck and a portion of the trash conveyor of the apparatus of FIG. I.

The conveyor pans 24, best shown in FIGS. 5 and 6, which make up the apron 22 are connected by hinges 26 and have overlapping upstanding edges 28. The apron 22 travels between two shafts 30, 32, shown in FIG. 1. One of the shafts 32 is driven by a motor 34 through a speed reducer 36 as shown in FIG. 4. Sprocket drive wheels 38 mounted to the driven shaft 32 drive the apron 22 about an endless path. An idler sprocket 39 on the idler shaft 30 supports the apron 22. Idler support wheels (not shown) underlie and support the upper portion 40 of the apron 22 which passes over the top of the sprocket wheels 38, 39. Conveyors of this type are available from a number of industry suppliers, including Webster Chain.

The pans 24 have outwardly facing surfaces 42 which on the upper portion 40 of the apron 22 form a conveying surface 44. The conveying surface 44 moves trash bags 29 supplied by an infeed chute 48 from an infeed end 50 to an outfeed end 52. Triangular teeth 23 are welded to the outwardly facing surfaces 42 of the pans 24. The teeth 23 are thin upstanding plates and are aligned with the direction of motion of the apron 22. The teeth 23 puncture the bags 29 and hold them in place on the apron 22.

The bags 29 thus held on the apron 22 are moved under the deck 25. As shown in FIG. 6, the deck 25 is constructed as a four-sided pan 54. The forward side 56 is sloped upwardly so the bags 29 travel under the pan bottom 58. The deck teeth 27 are welded to the lower face 60 of the pan bottom 58. The long sides 62 of the tray together with the forward side 56 and the rear side 64 stiffen the pan 54 and provide pivot attachment points 66 for the pivot links 68. Additional stiffening (not shown) is provided on the upper face 70 of the pan bottom 58.

The upper face 70 of the pan bottom 58 has four posts 72 on which are stacked weights 74, as best shown in FIG. 6. The weights 74 allow the total downward force on the deck to be adjusted by the addition or subtraction of weights 74. The total weight of the deck illustrated in FIG. 6 is about 943 lb. for a deck with a width of about 3 feet 9 inches by 4 feet 6 inches. The amount of weight attached to the deck will not normally be adjusted once the machine is placed in operation; however, the removability of the weights 74 allows adjustments during initial setup and testing.

The teeth 23 on the apron 21 are arranged in rows 75 of six teeth spaced about 8 inches apart across the rows 75. The upstanding teeth 23 are about 6 inches high and have the shape of a right angle. The hypotenuse 76 faces the infeed chute 48 and the long sides 78 are welded to the upper surfaces 42 of the pans 24. Short sides 80 face the direction the teeth 23 are moving. The short vertical sides 80 provide positive engagement with the bags 29 forcing the bags through the opposed depending deck teeth 27. The points of the triangular teeth 23 adjacent the hypotenuses are clipped to prevent their becoming bent.

The depending teeth 27 mounted on the deck are shaped like isosceles triangles where the base is welded to the lower face 60 of the pan bottom 58. Unlike the upstanding teeth 23 on the conveyor 21 the depending teeth 27 do not need to push the trash bag 29 or the trash 82 along the conveyor 21. The depending teeth only need to penetrate the bags 29 as they are dragged past the depending teeth 27. Thus the sloping sides 84 of the depending teeth 27 are designed to slice into the bag 29 and not catch plastic bags 86 on the depending teeth 27.

The depending teeth 27 are mounted in rows 86. The spacing of the teeth 27 within the rows is important for the improved ability of the bag breaker 20 to reliably open bags of all sizes, but particularly smaller bags. If the teeth 27 are aligned, each successive tooth cuts trash bags 29 in the same place. Staggering the teeth 27 causes the bags to rotate as each tooth impacts the bag 29. Thus successive teeth open new cuts in the trash bags 29.

The upper deck has six rows of teeth 27. Outer teeth 88 are aligned along and about 9/16th inches from the outer edge 90 of the four sided pan 54 with a gap between rows 86 of about 1 inch. Each row 86 has seven teeth 27. In the first row 92 of teeth 27 adjacent to the forward side 56 of the pan 54 the teeth are spaced 5-and-7/8th inches, 8 inches, 8 inches, 8 inches, 8 inches, and 5- and-7/8th inches apart. In the second row 94, the teeth are spaced 6-and-7/8th inches, 8 inches, 8 inches, 8 inches, 8 inches, and 4-and-7/8th inches apart. In the third row 96 the teeth are spaced 4 7/8th inches, 8 inches, 8 inches, 8 inches, 8 inches, and 6-and-7/8th inches apart. The fourth row 98 has spacing the same as the first row 92. The fifth row 100 has spacing the same as the second row, and the sixth row 102 is spaced the same as the third row. Thus as the upstanding teeth 23 attached to the conveyor apron 22 move through and interdigitate with the depending teeth 27 mounted on the deck 25 the spacing between the interdigitated teeth changes with the result of better bag opening performance, especially with smaller bags.

Figure 3:
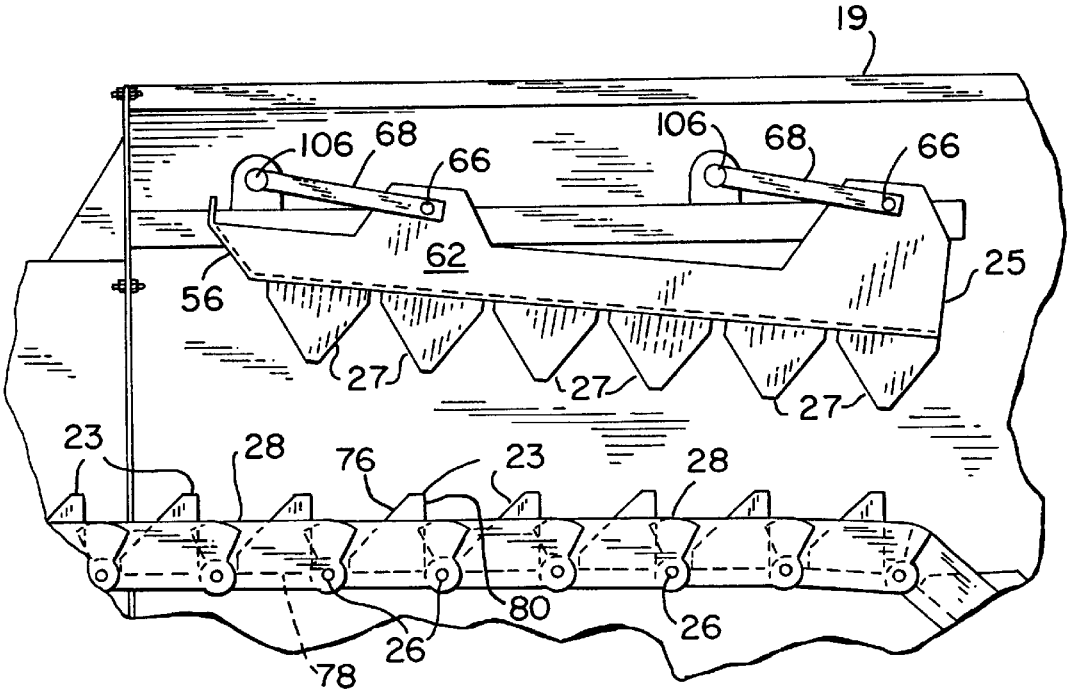
FIG. 3 is an enlarged details view of the pivoting deck of FIG. 1 showing the deck in the raised position.

The deck 25 is angled with respect to the conveyor apron 22 to form a receiving throat 104 which opens towards the infeed end 50 and the infeed chute 48. The throat 104 opens wider as the deck pivots on the pivot links 68. The pivot links 68 are mounted to overhead pivoting attachment points 106 attached to the bag breaker frame 19 as shown in FIGS. 1 and 4. Pivoting of the deck 25 not only opens the throat 104 to allow large items of trash to pass through to the exit 108, but also allows the deck to be raised for maintenance. During maintenance a fixture (not shown) or a positive locking mechanism is used to hold the deck in the raised position as shown in FIG. 3.

In the processing of municipal trash, the trash often consists of recyclables which are in bags, and trash which is not bagged. Often the processing line is the same for both types of trash. The bag breaker performs no useful function if no bags are present. The deck 25 can be raised as shown in FIG. 3 and pins 67, shown in FIG. 4, positioned beneath stops 69 which are welded to the shaft 71 to hold the deck 25 out of engagement with the trash which moves under the deck 25. This effectively removes the bag breaker 20 from the processing of the trash. In such a case, the bag breaker 20 simply functions as a conveyor. If no bags are present then no purpose is served by the deck. Because the apparatus 20 allows the deck to be swung up and held by pins 67, it becomes possible to take the bag opening process off-line without removing the equipment from the flow of trash.

Doors 110 as shown in FIG. 4 are mounted on the ouffeed end 52 of the frame 19. The doors 110 allow access to the trash exit 108 and the space between the deck 25 and the apron 22.

An alternative arrangement of teeth 109 on a deck 111 is shown in FIGS. 8 and 9. The teeth 109 are staggered in a manner similar to the teeth 27 on the deck 25 with the spacing of the teeth 109 for example being identical to the spacing on the teeth 27. However in addition to a spacing which staggers the teeth, the central teeth in the second row 113, third row 115, fifth row 117, and sixth row 119 are canted towards the sides 121, 123 at an angle of about five degrees. The central teeth 125 in rows 113, 117 are canted towards the side 121 and the central teeth 127 in rows 115 and 119 are canted towards the side 123 of the deck 111. Canting the teeth 109 will improve the ability of the bag breaker 20 to open bags of varying sizes.

Figure 7:
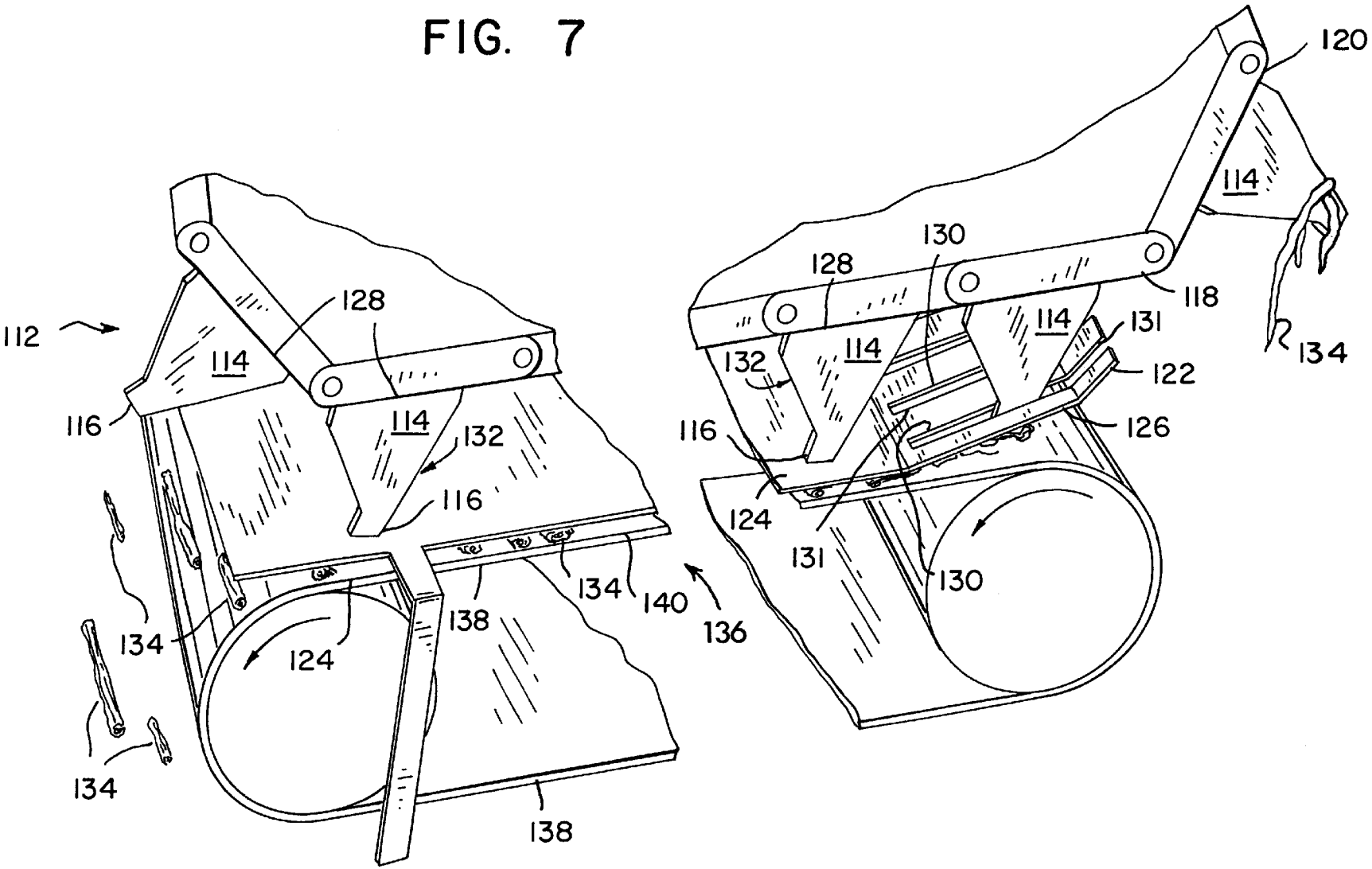
FIG. 7 is a fragmentary isometric view of an alternative embodiment of the bag breaker of FIG. 1 wherein a drag chain is used instead of a pan conveyor and including a tooth cleaner and bag-compacting apparatus.

FIG. 7 illustrates a bag breaker 112 which employs an alternative upstanding tooth design 114 in which the right angle teeth 114 have rectangular extensions 116. The bag breaker 112 employs chains 118 to which the teeth 114 are mounted. The chains 118 form a drag chain conveyor 120 such as commonly used in the log handling industry. The drag chain conveyor 120 moves between sprocket wheels on bearings similar to bearings or shafts 30, 32 the bearings define an upper path or conveying surface and a lower or return path as the conveyor apron 22 or chains 118 move in a endless path. The chain conveyor is driven by a motor similar to the motor 34.

FIG. 7 illustrates a teeth cleaner 122 which consists of a plate 124 positioned beneath the drag chain conveyor teeth 114. The plate 124 has a flange 126 which extends upwardly towards the base 128 of the teeth 114. Portions of the flange 126 define narrow slots 130 through which the teeth 114 move. The edges 131 of the slots 130 scrape the sides 132 of the teeth 114 cleaning plastic bags 134 which cling to the teeth 114. A conveyor 136 is positioned beneath the plate 124. The conveyor has a belt 138 which moves in the same direction as the teeth 114. The upper surface 140 of the belt is slightly spaced from and parallel to the plate 124. The plastics bags 134 which are removed from the teeth 114 are dragged between the plate 124 and the conveyor upper surface 140 by the motion of the conveyor. Because the bags are trapped between a moving surface, the conveyor belt, and a non-moving surface, the plate 124, the bags are forced to roll along the plate 124. This compacts the bags into cigar like bundles which increase the density of the plastic bags 134 and ease their handling or further recycling for disposal.

With teeth 23 shaped as shown in FIGS. 1–3 and 5–6 approximately fifty percent of the plastic bags 134 are removed from the flow of trash 82. With teeth which are optimized for catching bags removal rates of ninety percent may be possible. The teeth 114 shown in FIG. 7 have a rectangular portion 116 which will retain plastic bags 134.

Figure 10:
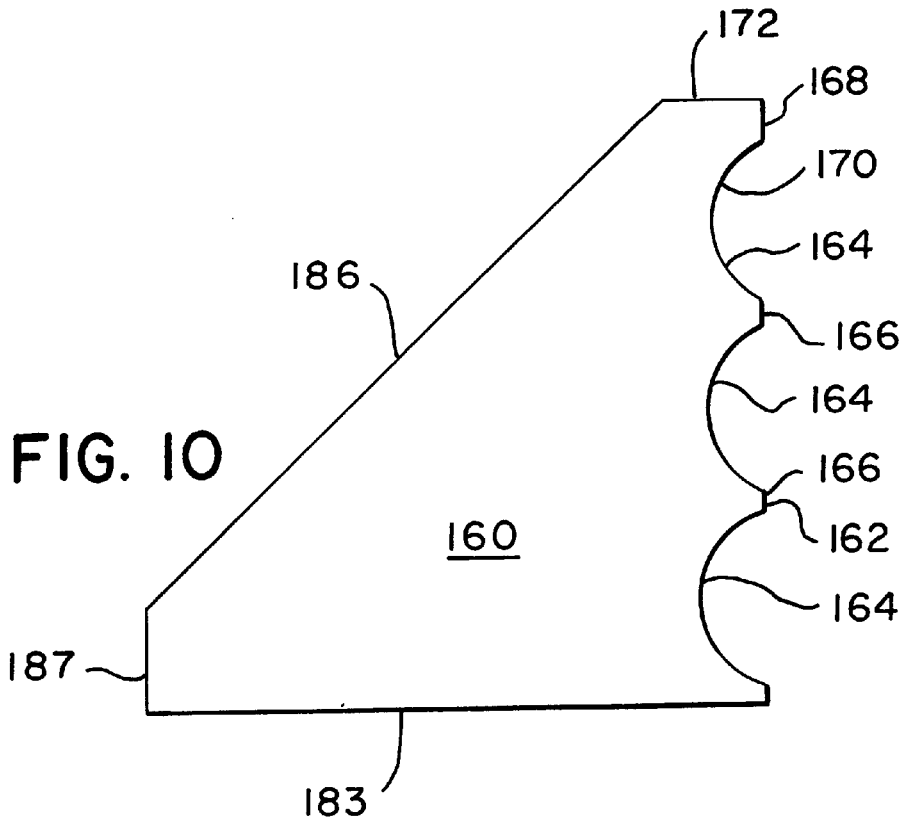
FIG. 10 is side elevational view of an alternative tooth design for use with the bag breaker of FIG. 1.
Figure 11:
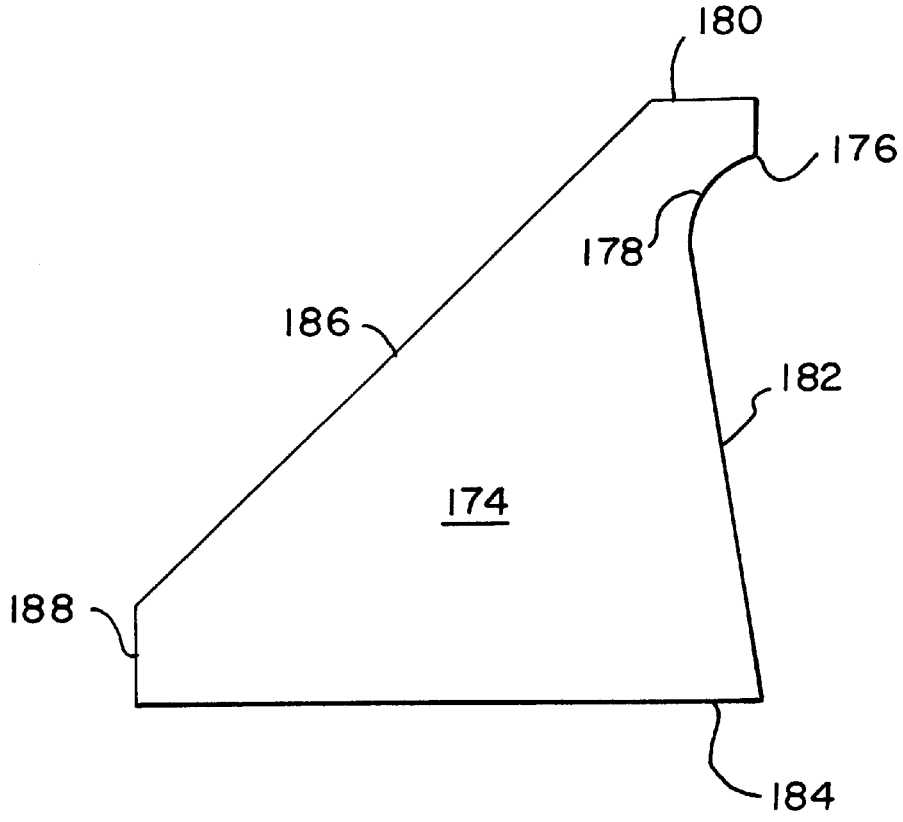
FIG. 11 is a side elevational view of another alternative tooth design for use with the bag breaker of FIG. 1.

Additional teeth designs are shown in FIGS. 10 and 11 which should have superior performance in removing trash bags from the trash being processed. The tooth 160 has a leading edge 162 and a trailing edge 186. The leading edge 162 has three serrations 164 formed therein. Projections 166 formed between the serrations 164 and a hook 168 formed by the uppermost serration 170 and the top 172 of the tooth 160 snag the plastic bags 134 and remove the bags from the trash being processed. The tooth 160 is mounted to a conveyor by a base 183. The trailing edge 186 is terminated by a short vertical edge 187.

Another tooth design 174 shown in FIG. 11 has a single hook 176, similar to the hook 168, which is formed by a curved indentation 178 and the top 180 of the tooth 174. The leading edge 182 of the tooth 174 slopes up from a base 184 and is tangent to the curved indentation 178. The tooth 174 as a trailing edge 186 which is terminated by a short vertical edge 188.

Removal of plastic bags from the flow of trash results in considerable cost savings by reducing or eliminating the labor necessary to remove the bags from the recycled materials.

It should be understood that the teeth cleaner 122 can be used with the bag breaker 20 or with a bag breaker where the teeth are mounted on a flexible surface such as a fiber reinforced rubber belt.

It should be understood that components of the bag breaker not shown in FIG. 7 are similar to or identical to the features shown in the other figures. In addition, while the conveyor 20 for moving the trash under the deck 25 will preferably be of the apron feeder type, other conveyors such as illustrated in FIG. 7 could be used.

The bag breaker 20 should be used with a mechanism or apparatus for leveling the height of trash and trash bags on the apron 22 to prevent the bag breaker 20 from becoming jammed.

It is understood that the invention is not limited to the particular construction and arrangement of parts herein illustrated and described, but embraces such modified forms thereof as come within the scope of the following claims.

We claim:

1. An apparatus for opening garbage bags to discharge refuse contained therein, the apparatus comprising:

a conveyor having a conveying surface having a multiplicity of upstanding teeth mounted thereon, wherein bags to be opened are received on the conveying surface and advanced thereon;

a motor mounted in driving relation to the conveyor to cause the surface of the conveyor to move in a first direction;

a deck pivotally mounted above the conveying surface, the mounting allowing motion of the deck away from the conveying surface and in the first direction; and a multiplicity of depending teeth fixedly mounted to the deck and extending downwardly and interdigitating with the upstanding teeth mounted on the conveying surface.

2. The apparatus of claim 1 wherein the upstanding teeth on the conveying surface are positioned on the conveying surface in parallel rows and wherein the spacing between the teeth in each row is the same in all the rows and wherein the depending teeth are positioned on the deck in rows so that the spacing between an upstanding row of teeth and depending teeth in a first row varies with the spacing between the upstanding row of teeth and depending teeth in a second row.

3. The apparatus of claim I wherein at least a plurality of the depending teeth on the deck depend downward and also are angled transversely to the first direction.

4. The apparatus of claim 3 wherein the depending teeth are angled about five degrees from the vertical.

5. The apparatus of claim 1 wherein the depending teeth are arranged in sequential rows arrayed in the first direction and wherein the spacing between teeth in each row is varied between adjacent rows in the sequence of rows.

6. The apparatus of claim 1 wherein the deck depending teeth are arranged in sequential rows arrayed in the first direction and wherein the deck has a first side and a second side parallel to the first direction and wherein teeth in the rows which are adjacent to the first and second sides depend vertically downwardly and wherein teeth in each row between the teeth adjacent to the sides follow a sequence in sequential rows of depending vertically downwardly, depending downwardly and angled towards the first side, and depending downwardly and angled towards the second side.

7. The apparatus of claim 1 wherein the conveyor comprises an apron feeder and is constructed of linked metal pans.

8. The apparatus of claim 1 wherein the deck is suspended from four links arrayed in a rectangular pattern which attach the deck to a machine frame which is also connected to the conveyor.

9. The apparatus of claim 1 wherein the teeth on the conveying surface have the approximate shape of right triangles which have one side attached to the belt and a hypotenuse side facing away from the first direction.

10. The apparatus of claim 1 wherein the bag breaker has an infeed end and an outfeed end, and the conveying surface moves between the infeed end and the ouffeed end, and wherein the deck is mounted above the conveying surface closer to the outfeed end than the infeed end.

11. The apparatus of claim 1 wherein:

the conveyor has an endless conveying surface moving between two bearings, the bearings defining an upper path and a lower path along which the conveying surface moves, and wherein bags to be opened are received on the conveying surface as it moves along the upper path;

wherein the motor causes the surface of the conveying surface to move in the first direction from the upper path to the lower path;

a plate positioned beneath the conveyor and spaced below the teeth as they move along the lower path, the plate having a flange which extends upwardly towards the conveying surface, the flange having portions defining teeth cleaning slots through which the teeth mounted on the conveying surface move, so that plastic trash bags are removed from the teeth; and a second conveyor positioned beneath the plate and having an endless belt which moves in close proximity to the plate so that plastic bags removed from the teeth are received between the plate and the endless belt, the belt moving beneath the plate causing the plastic bags to roll between the moving belt and the stationery plate.

12. The apparatus of claim 11, wherein the upstanding teeth are substantially triangular and have a base and a top which is a portion of the blade most distal from the base, the teeth bases being mounted to the conveyor and the teeth having a leading edge which is substantially perpendicular to the base, the leading edge having portions forming at least one serration, the serration having the form of a curved indentation in the leading edge, the serration being closely spaced from the top of the blade to form a hook for engaging plastic bags and removing them from a flow of trash.

13. The apparatus of claim 12 wherein the leading edge has three serrations and wherein the serrations form projections on the leading edge for engaging plastic bags and removing them from a flow of trash.

14. An apparatus for opening garbage bags to discharge refuse contained therein, the apparatus comprising:

a conveyor comprising an apron feeder having an endless apron of overlapping pans forming a conveying surface, wherein a multiplicity of upstanding teeth are mounted to the pans, the conveyor having an infeed end and an outfeed end;

a motor mounted in driving relation to the conveyor to cause the surface of the conveyor to move in a first direction;

a deck pivotally supported above the conveying surface to allow pivoting of the deck away from the conveying surface and in the first direction; and a multiplicity of depending teeth fixedly mounted to the deck and extending downwardly and interdigitating with the upstanding teeth mounted on the conveying surface.

15. The apparatus of claim 14 wherein the upstanding teeth on the conveying surface are positioned on the conveying surface in parallel rows and wherein the spacing between the teeth in each row is the same in all the rows and wherein the depending teeth are arranged within each row attached to the deck so that the spacing between the upstanding teeth and depending teeth in a first row varies with the spacing between the upstanding teeth and depending teeth in a second row.

16. The apparatus of claim 14 wherein the deck is suspended from four links arrayed in a rectangular pattern which attaches the deck to a machine frame which is also connected to the conveyor.

17. The apparatus of claim 14 wherein the teeth on the conveying surface have the approximate shape of right triangles which have one side attached to the belt and a hypotenuse side facing away from the first direction.

18. The apparatus of claim 14 wherein the deck is mounted above the conveying surface closer to the ouffeed end than the infeed end.

19. An apparatus for opening garbage bags to discharge refuse contained therein, the apparatus comprising:

a conveyor having an endless conveying surface moving between two bearings, the bearings defining an upper path and a lower path along which the conveying surface moves, the conveying surface having a multiplicity of upstanding teeth having bases which are mounted to the conveyor, wherein bags to be opened are received on the conveying surface as it moves along the upper path;

an opposing structure which rends bags of trash as the upper conveying surface moves through the opposing structure;

a motor mounted in driving relation to the conveyor to cause the surface of the conveying surface to move in a first direction from the upper path to the lower path;

a plate positioned beneath the conveyor and spaced below the teeth as they move along the lower path, the plate having a flange which extends upwardly towards the bases of the teeth, the flange having portions defining teeth cleaning slots through which the teeth mounted on the conveying surface move, so that plastic trash bags are removed from the teeth; and a second conveyor positioned beneath the plate and having an endless belt which moves in close proximity to the plate so that plastic bags removed from the teeth are received between the plate and the endless belt, the belt moving beneath the plate causing the plastic bags to roll between the moving belt on the plate.

20. The apparatus of claim 19 wherein the opposing structure is a deck pivotally supported above the conveying surface the pivots allowing motion of the deck away from the conveying surface and in the first direction;

a multiplicity of depending teeth fixedly mounted to the deck and extending downwardly towards the upstanding teeth mounted on the conveying surface.

21. The apparatus of claim 20 wherein the upstanding teeth on the conveying surface are positioned on the conveying surface in parallel rows and wherein the spacing between the teeth in each row is the same in all the rows and wherein the depending teeth are positioned on the deck in rows which interdigitate with the upstanding teeth and wherein the depending teeth are arrayed within each row attached to the deck so that as the upstanding teeth move through the teeth on the deck the spacing between the upstanding teeth in a row and depending teeth in a first row varies with the spacing between the upstanding teeth and depending teeth in a second row.

22. The apparatus of claim 20 wherein the upstanding teeth on the conveying surface and the depending teeth on the deck are positioned to interdigitate with the upstanding teeth and wherein the depending teeth are arrayed on the deck, and the upstanding teeth are arrayed on the conveying surface, so that as the upstanding teeth move through the teeth on the deck a distance defined between individual upstanding teeth and individual depending teeth varies as the upstanding teeth interdigitate with teeth on the deck.

23. The apparatus of claim 20 wherein the deck is suspended from four links arrayed in a rectangular pattern which attach the deck to a machine frame which is also connected to the conveyor.

24. The apparatus of claim 20 wherein the bag breaker has an infeed end and an outfeed end and the conveying surface moves between the infeed end and the outfeed end, and wherein the deck is mounted above the conveying surface closer to the outfeed end than the infeed end.

25. The apparatus of claim 19 wherein the conveyor comprises an apron feeder which is constructed of linked metal pans.

26. The apparatus of claim 19 wherein the teeth on the conveying surface have the approximate shape of right triangles which have one side attached to the belt and a hypotenuse side facing away from the first direction.

27. The apparatus of claim 19 wherein the teeth are substantially triangular and have a base and a top which is a portion of the blade most distal from the base, the teeth bases being mounted to the conveyor and the teeth having a leading edge which is substantially perpendicular to the base, the leading edge having portions forming at least one serration, the serration having the form of a curved indentation in the leading edge, the serration being closely spaced from the top of the blade to form a hook for engaging plastic bags and removing them from a flow of trash.

28. The apparatus of claim 27 wherein the leading edge has three serrations and wherein the serrations form projections on the leading edge for engaging plastic bags and removing them from a flow of trash.

* * * * *